United States Patent [19]

Hayes

[11] Patent Number: 4,807,647

[45] Date of Patent: Feb. 28, 1989

[54] VENTILATED CIGARETTE FILTER

[75] Inventor: Ernest B. Hayes, Leighton Buzzard, England

[73] Assignee: Cigarette Components Limited, London, England

[21] Appl. No.: 920,301

[22] Filed: Oct. 17, 1986

[30] Foreign Application Priority Data

Oct. 22, 1985 [GB] United Kingdom ..... 8525967

[51] Int. Cl.[4] ..... A24D 3/02; A24D 3/04

[52] U.S. Cl. ..... 131/336; 131/340; 131/344

[58] Field of Search ..... 131/336, 340, 344

[56] References Cited

U.S. PATENT DOCUMENTS 4,570,649 2/1986 Nichols et al. ..... 131/336

FOREIGN PATENT DOCUMENTS 1423516 2/1976 United Kingdom ..... 131/336

*Primary Examiner*—V. Millin

*Attorney, Agent, or Firm*—Fulwider, Patton, Rieber, Lee & Utecht

[57] ABSTRACT

A cigarette filter comprising longitudinally aligned core components a first of which is air-permeable and of relatively high pressure drop longitudinally of the filter but substantially air-impermeable radially of the filter and a second of which is air-permeable and of relatively low pressure drop longitudinally of the filter, and a common wrap or partial wrap which extends along and around or partially around said core components and provides for ventilation of the filter at a region longitudinally spaced from the first core component.

8 Claims, 3 Drawing Sheets

VENTILATED CIGARETTE FILTER

BACKGROUND OF THE INVENTION

The present invention relates to ventilated filters for cigarettes, and provides such a filter comprising longitudinally aligned core components a first of which is air-permeable and of relatively high pressure drop longitudinally of the filter but substantially air-impermeable radially of the filter and a second of which is air-permeable and of relatively low pressure drop longitudinally of the filter, and a common full or partial wrap which extends along and around or partially around said core components and provides for ventilation of the filter at a region longitudinally spaced from the first core component. The first and second core components may abut or be longitudinally spaced, and the ventilation may, for example, be radially into a radially air-permeable second component and/or into a space between first and second core components. The wrap may be a complete wrap of porous or perforate material of substantially uniform air-permeability along its length. It may instead be a partial wrap comprising one or more strips, the or each of which extends only partially around the filter core to leave between longitudinal strip edges gaps which extend longitudinally of the filter and into which free ventilation can occur.

The first core component is preferably radially impermeable over the whole of its cross section. It is preferably a unitary body, except for any outer wrapper which may form part of it. It is preferably substantially uniform over the whole of its cross section. It preferably occupies fully and uninterruptedly the whole of the cross section (other than that occupied by the common wrap or partial wrap) of the filter. The first core component thus suitably comprises a unitary substantially uniform plug of circular cross section which may include its own wrap.

In a filter cigarette, the filter according to the invention will normally be incorporated with the high pressure drop core component towards the tobacco rod and with ventilation into the filter downstream of the high pressure drop component towards the buccal end. The filter will normally be incorporated in a filter cigarette by means of a ventilating tipping overwrap, which will usually have ventilating perforations disposed downstream of the high pressure drop core component. The ventilating tipping overwrap may be the previously mentioned common wrap for the first and second core components, but more usually these core components will be preformed into a sub-assembly with the common wrap, and this sub-assembly subsequently incorporated in a filter cigarette by means of the ventilating tipping overwrap. The sub-assembly is preferably produced continuously, with the continuous rod being cut into finite lengths as it is produced; these finite lengths will usually be a multiple of the eventual individual filter lengths; in the production of filter cigarettes, a double length rod will usually be aligned longitudinally between two tobacco rods, joined thereto by a double-length tipping overwrap, and the assembly then cut centrally to form two filter cigarettes.

Various structures and materials are possible for the high pressure drop core component. It is currently preferred to employ plastics film, longitudinally corrugated, substantially without fibrillation so as to remain air-impermeable, and gathered laterally to form a filter plug which is permeable longitudinally, along the corrugations, but substantially impermeable radially. The gathered corrugated film may be bonded to itself to provide a self-supporting and dimensionally stable rod or plug, but more usually it will be retained in rod form by means of a wrapper. The plastics film is suitably of polyethylene.

The low pressure drop core component may be of conventional form, e.g., of gathered cellulose acetate filamentary tow or gathered creped porous paper. It is preferably a unitary body. It may be radially air-permeable. It is preferably substantially uniform over the whole of its cross section. It may occupy fully and uninterruptedly the whole of the cross section (other than that occupied by any wrap) of the filter. The second core component thus suitably comprises a unitary substantially uniform plug of circular cross section.

Each of the first and second core components, and the filter as a whole, is preferably of low inherent mechanical retention. In particular, in filters and filter cigarettes according to the invention, the percentage air-dilution via the filter is preferably greater than the percentage "non-ventilated" or "enclosed" tar retention of the filter, i.e., that measured for an equivalent filter or cigarette with air dilution via the filter prevented. The percentage air dilution, as referred to herein, is the percentage by volume of ventilating air added via the filter in the total mixture delivered by the filter; thus 50% ventilation or air dilution means that in each puff there is a 50/50 volume ratio of added air to original smoke, and 40% air dilution indicates a 40/60 ratio, and so on.

The invention relies on the relative properties of the first and second core components combined with the extent and location of ventilation) rather than on the absolute values of the properties of either. However, while this is by no means essential for a filter performing according to the invention, the first core component will generally have an enclosed pressure drop (i.e., that measured with ventilation prevented) of over 50 mm water gauge (Wg) and the second core component an enclosed pressure drop of less than 50 mm Wg. For a given type (composition, structure, packing density, etc.) of first core component the enclosed pressure drop will be proportional to length, and the same applies to the second core component; the enclosed pressure drops of the two components will be substantially additive, so that a desired enclosed pressure drop for the filter is readily achieved. For a second core component in the form of a conventional filter plug (e.g., gathered cellulose acetate tow) the variation of enclosed tar retention with enclosed pressure drop is usually substantially linear, with a ratio greater than unity, and an enclosed tar retention of less than 30% will generally be preferred.

For the first core component, there is preferably substantially less variation of enclosed tar retention with enclosed pressure drop, and an enclosed tar retention of less than 20% will usually be preferred. The enclosed tar retention of the filter will preferably be under 40%.

The filter according to the invention can achieve the usually irreconcilable objectives of on the one hand permitting a very high degree of air-dilution (e.g., 50% or 60% or more) to give good reduction of CO without, on the other hand, reducing the taste and pressure drop of the filter cigarette to unacceptably low levels. Various prior filter structures have aimed at this performance, but the filter of the present invention can achieve it to an improved degree by use of a very high pressure drop, low retention upstream core component in combination with a low pressure drop, low retention downstream core component, with high air dilution downstream of the high pressure drop component; the improved performance is obtainable with a filter which is of essentially uniform cross section, without implants or capillary tubes etc. which have been proposed for the purpose in the past and which can become blocked to impair the performance; the whole cross section of the filter can be used, and the filter can be of conventional appearance and would present an even end staining during smoking; furthermore, in view of the very high pressure drop which can be provided by the first (upstream) core component, it is relatively easy to obtain the high air dilution levels desired without having to use exceptionally porous tipping, relatively small ventilation perforations being adequate; the combination of small ventilation holes and high upstream pressure drop can prevent or reduce the escape of smoke through the ventilation holes between puffs, the latter being an undesirable phenomenon frequently encountered with prior ventilated filters.

The invention is further illustrated by the following practical data and examples to be taken in conjunction with the accompanying drawings.

DETAILED DESCRIPTION OF THE INVENTION

The following Table 1 sets out the enclosed pressure drops (PD) for a number of first core components suitable for use in the invention, together with the enclosed tar retention (TR) for these components when employed alone with respective identical standard UK kingsize tobacco rods. In each case the first core component consists of a plug of longitudinally corrugated and unfibrillated polyethylene film gathered into rod form with an external wrapper; the different pressure drops for plugs of the same length reflect differences in packing density of the gathered film from plug to plug.

TABLE 1

| First Core Component Length | PD (mm Wg) | % TR |
|---|---|---|
| 6 mm | 75 | 11.5 |
| 6 mm | 94 | 12.5 |
| 8 mm | 85 | 13.9 |
| 10 mm | 143 | 17.5 |
| 10 mm | 169 | 16.5 |
| 10 mm | 212 | 16.5 |
| 15 mm | 208 | 21.0 |

Figure 1:
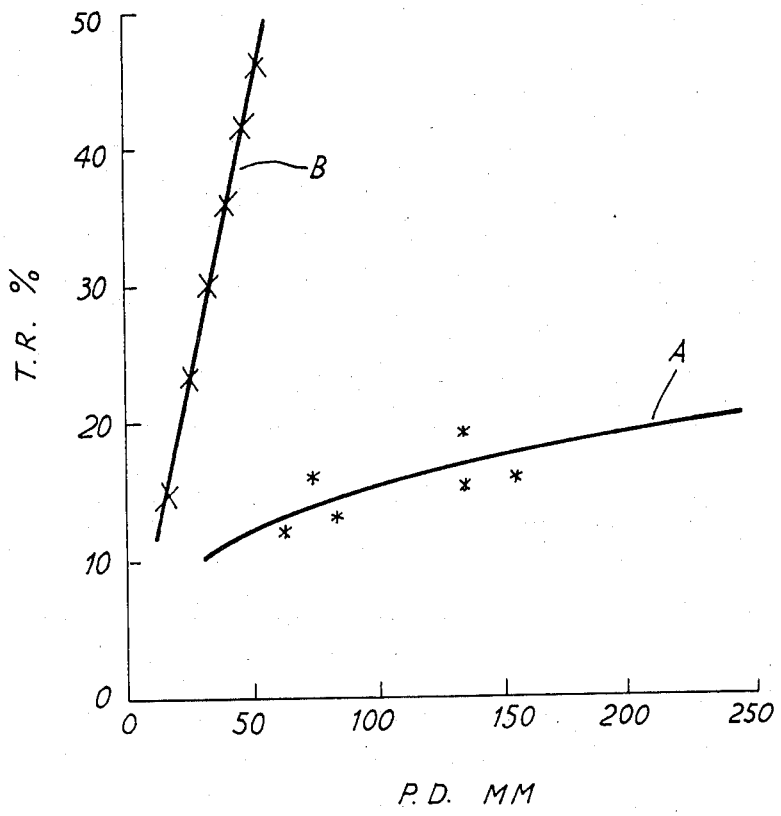
FIG. 1 is a graph illustrating properties of first and second core components for use in filters according to the invention.

FIG. 1 of the attached drawings is a graph illustrating the variation of enclosed tar retention (T.R) with enclosed pressure drop (P.D) for a first and a second core component suitable for use in the invention. Line A was obtained by plotting the enclosed tar retention against enclosed pressure drop for first core components (of the type described above in connection with Table 1) which were of different lengths but otherwise substantially identical. Line B was obtained in the same way for different length but otherwise identical second core components each in the form of a plug of gathered and bonded 8 filament denier cellulose acetate tow. The second core components varied in length from 10 to 35 mm, and the first core components from 6 to 15 mm. It is seen that the tar retention of the first core components is relatively insensitive to pressure drop; thus with appropriate selection of first and second core components and provision of a desired degree of ventilation downstream of the first component, a predetermined and improved filter performance, as discussed above, is readily achieved.

The performance characteristics of filters and filter cigarettes according to the invention are illustrated by the figures quoted in the following Tables 2 and 3. Table 2 indicates the enclosed filter pressure drop (in mm water) and enclosed percent tar retention of two filters according to the invention which are respectively 20 and 25 mm in length and about 25 mm in circumference, when each filter was employed in conjunction with a standard UK king size tobacco rod; it also gives these values for the individual core components. Table 3 compares these two filters with two commercially available brands of conventional "monoacetate" filter cigarettes of the same dimensions. In each case, the filter of the invention was attached to a tobacco rod identical to that of the commercially available comparison. In each case, the conventional "monoacetate" filter is a gathered bundle of cellulose acetate filamentary tow. The filters according to the invention each consist of a first upstream plug of longitudinally corrugated and unfibrillated polyethylene film gathered into rod form with an external wrapper, an abutting unwrapped downstream plug of gathered and bonded 8/40 cellulose acetate tow (filament denier 8, total denier $40\times1000$), and a common air-permeable plugwrap. In the filter according to the invention which is 25 mm in length, the upstream plug (of corrugated polyethylene film) is 10 mm in length and the downstream plug of bonded cellulose acetate filamentary tow is 15 mm in length; in the filter according to the invention which is 20 mm in length, the upstream plug of corrugated polyethylene film is 6 mm in length, and the downstream plug of bonded cellulose acetate filamentary tow is 14 mm in length. The filters are attached to the tobacco rods by tipping overwrap having ventilation perforations which are similarly placed in each case—over the second core component in the filters according to the invention.

Unless otherwise specified, all of the measured values quoted herein are obtained by the accepted procedures recommended by CORESTA (Centre de Cooperation pour les Recherches Scientifiques Relatives au Tabac).

The filter according to the invention can give improved reduction not only of CO but also of other vapor phase components such as HCN, formaldehyde, etc., to give a better vapor phase/tar reduction ratio than previous filters.

It is also much easier to incorporate adsorbent (e.g., active carbon) for further vapor phase reductions in filters according to the invention (e.g., between spaced first and second core components) than is the case with previous high ventilation, low retention filters.

TABLE 2

| | Filter | 1st Core Component | 2nd Core Component |
|---|---|---|---|
| Length (mm) | 20 | 6 | 14 |
| PD (mm Wg) | 118 | 85 | 33 |
| Tar Retention % | 34.5 | 12 | 27 |
| Length (mm) | 25 | 10 | 15 |
| PD (mm Wg) | 200 | 164 | 36 |
| Tar Retention % | 37.5 | 16.5 | 29 |

Figure 2:
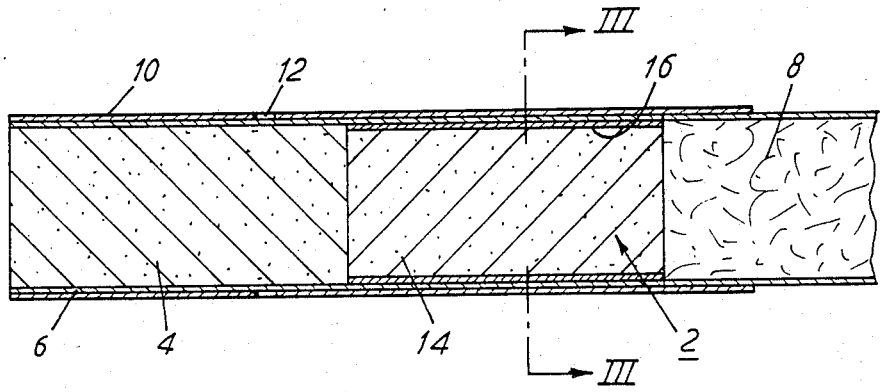
FIG. 2 is a schematic longitudinal sectional view of a filter according to the invention incorporated in a filter cigarette.
Figure 3:
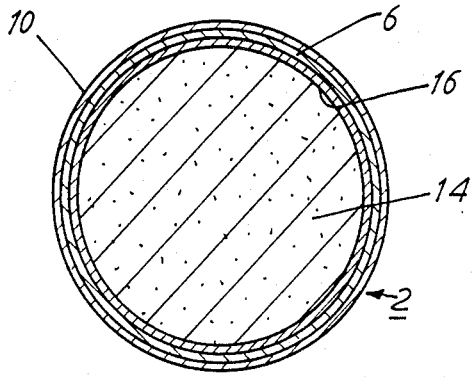
FIG. 3 is a cross-sectional view on lines III—III of FIG. 2.
Figure 4:
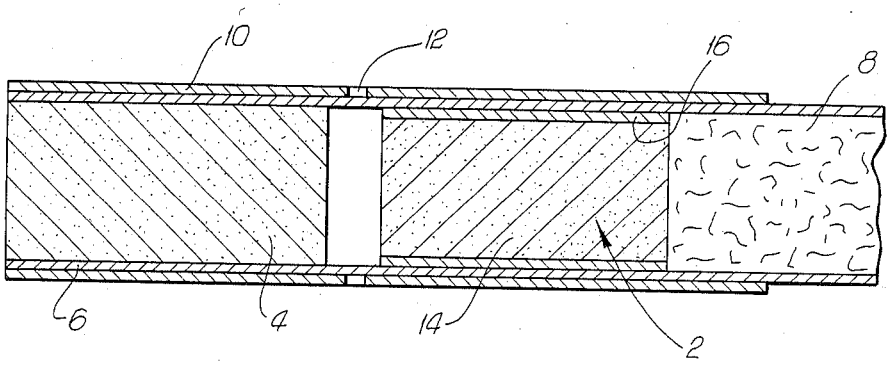
FIG. 4 is a cross-sectional view of another embodiment of the invention having a space between the two filter components.

FIGS. 2 and 3 of the accompanying drawings illustrate the 20 mm length filter according to the invention of Tables 2 and 3. This filter comprises the upstream first core component 2 and abutting downstream second core component 4 in a common air-permeable plugwrap 6. This sub-assembly is attached to a wrapped tobacco rod 8 by means of tipping overwrap 10 having a ring 12 of ventilating perforations in register with core component 4. As indicated by FIG. 3, the upstream first core component 2 is a unitary substantially uniform plug 14 in a wrap 16 which extends fully and uninterruptedly (i.e., without peripheral or significant internal by-pass passages) across the full cross section of the filter within the common wrap 6. As previously indicated as shown in FIG. 4, the core member 4 could be spaced downstream from core member 2, with the ventilating perforations then preferably being in register with the cavity between the two core components.

TABLE 3

| | Filter Length (mm) | | | |
|---|---|---|---|---|
| | 25 | 25 | 20 | 20 |
| | Filter Type | | | |
| | Mono-acetate | Invention | Mono-acetate | Invention |
| Cigarette PD Open Vents (mm water) | 166 | 114 | 117 | 84 |
| Tip Ventilation (%) | 16 | 57 | 27 | 57 |
| TPM (WNF) Yield (mg) | 9 | 8.8 | 9 | 8.8 |
| Nicotine Yield (mg) | 0.9 | 1.12 | 0.9 | 1.02 |
| Carbon Monoxide Yield (mg) | 13 | 5.7 | 10 | 5 |

TABLE 3-continued

| | Filter Length (mm) | | | |
|---|---|---|---|---|
| | 25 | 25 | 20 | 20 |
| | Filter Type | | | |
| | Mono-acetate | Invention | Mono-acetate | Invention |
| Carbon Monoxide/ Tar Ratio | 1.44 | 0.65 | 1.11 | 0.50 |
| Nicotine/ Tar Ratio | 0.10 | 0.13 | 0.10 | 0.12 |
| *Vapor Phase Index | 26.7 | 11.2 | 23.3 | 12.8 |

*Vapor Phase is an arbitrary value derived from the total peak heights of 4 important VP compounds as determined by gas chromatography.

What is claimed is:

1. A cigarette filter comprising a pair of longitudinally aligned core components, a first core component which is longitudinally air-permeable and has a relatively high pressure drop longitudinally of the filter and which is substantially air-impermeable radially of the filter across essentially the entire cross section thereof, a second core component which is air-permeable and has a lower pressure drop longitudinally of the filter than the first core component, an a common full or partial warp which extends along and at least partially around the pair of core components and provides for ventilation of the filter at a region longitudinally spaced from the first core component.

2. A filter according to claim 1 wherein the first and second core components abut.

3. A filter according to claim 1 wherein the first and second core components are longitudinally spaced.

4. A filter according to claim 1 wherein the second core component is air-permeable radially of the filter.

5. A filter according to claim 1 wherein the first core component has a substantially uniform construction over the whole of its cross section.

6. A filter according to claim 1 wherein the second core component has a substantially uniform construction over the whole of its cross section.

7. A filter according to claim 1 wherein the first core component comprises a plastics film longitudinally corrugated substantially without fibrillation and gathered laterally into a plug which is air-permeable longitudinally but substantially air-impermeable radially.

8. A filter cigarette incorporating a filter according to claim 1 with the first core component towards the tobacco rod and the second core component downstream of the first towards the buccal end of the filter, there being ventilation into the filter downstream of the first core component.

* * * * *